United States Patent [19]

Efferson

[11] 4,372,338

[45] Feb. 8, 1983

[54] HIGH PRESSURE VALVE ASSEMBLY

[75] Inventor: Chester C. Efferson, Ethel, La.

[73] Assignee: Dresser Industries, Inc., Dallas, Tex.

[21] Appl. No.: 171,098

[22] Filed: Jul. 22, 1980

[51] Int. Cl.[3] ..... F16K 5/22; B08B 3/04

[52] U.S. Cl. ..... 137/240; 137/246.11; 137/246.12; 137/246.22; 134/104; 162/246; 222/368; 406/105

[58] Field of Search ..... 137/237, 238, 240, 246.11, 137/246.12, 246, 625.47, 246.22, 597; 162/52, 246; 241/28; 222/368, 630; 406/63, 64, 67, 105; 134/104

[56] References Cited

U.S. PATENT DOCUMENTS

| | | | |
|---|---|---|---|
| 941,024 | 11/1909 | Martins | 406/67 |
| 2,630,293 | 3/1953 | Smith | 137/240 |
| 2,788,796 | 4/1957 | Harris | 137/246.22 |
| 2,960,245 | 11/1960 | Knapp | 406/67 |
| 3,026,894 | 3/1962 | Brooks | 137/246.22 |
| 3,982,789 | 9/1976 | Funk | 406/105 |
| 4,187,043 | 2/1980 | Kindersley | 406/105 |

FOREIGN PATENT DOCUMENTS

| | | | |
|---|---|---|---|
| 1217977 | 3/1960 | France | 162/246 |
| 103506 | 1/1964 | Norway | 162/246 |
| 324949 | 6/1970 | Sweden | 406/105 |

*Primary Examiner*—George L. Walton
*Attorney, Agent, or Firm*—Daniel Rubin

[57] ABSTRACT

A high pressure rotary plug valve having at least one groove in the housing to provide a flushing/lubricating flow of innocuous fluid between the housing and rotary plug thus preventing fine solids build-up and decrease wear.

4 Claims, 5 Drawing Figures

HIGH PRESSURE VALVE ASSEMBLY

BACKGROUND OF THE INVENTION

This invention relates to a high pressure valve assembly useful for taking streams of fluids at relatively low pressures and transferring them to high pressure streams. Such valves experience great wear when the fluids involved are solids-containing slurries, such as, for example, steamed wood chips in liquor, as is known in the pulp and paper industry.

It is generally known in the industry employing such high pressure rotary plug valves having offset ports in the rotary plug that the solids in the slurries so handled tend to cause wear in the valve plug and surrounding liner in circular bands at the top, central portion and bottom of the rotary plug and corresponding portions of the liner. This wear pattern can be overcome temporarily by laterally adjusting the plug in the valve housing until the wear becomes too great, i.e., the plug impinges on the end bell or cover or until lateral displacement causes undesired overlap of the offset ports allowing the slurry to leak back from the high pressure side to the low pressure side.

In an effort to reduce valve body wear, pressure equalization and purge lines have been added directly to the high pressure feeder with the point of tie-in at the end bells. Thus, a continuous purge is provided to keep the end bells free of fine solids contained in the slurry, causing wear at each end of the valve. This results in an equalization of pressure on the ends of the valve and decreases the load on the valve with a resultant increase in valve life and decrease in operating cost.

However, end bell purging has no effect on the circular banding wear which occurs on the valve plug and liner. Such wear patterns require rebuilding the valve after a relatively short service life, i.e., from at least 6 months to not more than 3 years with an average service life of about 15 months. Thus, there is a need for improved life high pressure rotary plug valves. There is also a need for such valves having decreased circular banding wear, decreased operating load and increased service life. These and other additional needs are met by the article of the present invention.

SUMMARY OF THE INVENTION

The present invention provides a rotary plug valve assembly adapted to receive a slurry at relatively low pressure and discharge the same to a system at relatively high pressure without substantial communication of the high and low pressure systems. The valve comprises a housing having low pressure slurry inlet and outlet means on opposite sides of said housing and spaced apart therefrom oppositely located high pressure fluid inlet and slurry outlet means, a tapered valve plug having a plurality of ports therein defining the opening of a chamber in said valve plug, said valve plug being rotatably held in said housing at one end by a drive shaft and bearings passing through a first end cover and at the other end of said housing by a laterally adjustable means passing through a second end cover, said valve plug ports being in registry with said housing inlets and outlets in a predetermined sequence during rotation of said valve plug, said housing having at least one groove circumferentially described and connected to a source of fluid of the character of that being transferred from the low pressure side to the high pressure side and controlled by at least one control means so that upon rotation of said valve plug in said housing a port in register with said low pressure inlet means fills said chamber with said slurry and upon further rotation empties said slurry into said high pressure outlet means, said fluid being pumped from a convenient source thereof to said groove to provide a flushing flow of said fluid to said housing and between said valve plug to lubricate and decrease wear of said valve plug and said housing.

DESCRIPTION OF THE DRAWINGS

The present invention will be more easily understood by reference to the drawings in which.

DETAILED DESCRIPTION OF PREFERRED EMBODIMENTS

Figure 1:
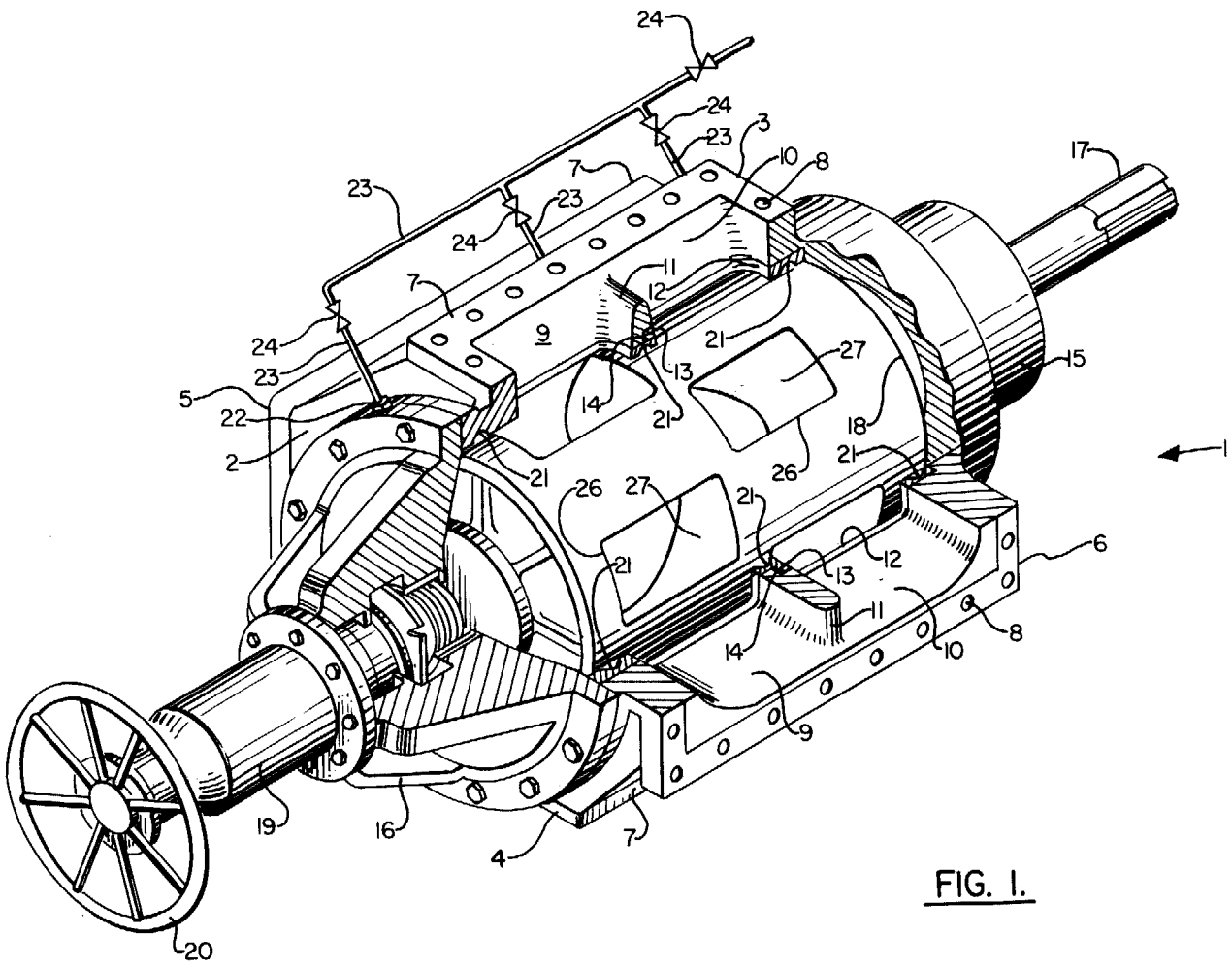
FIG. 1 is a partially cutaway perspective view of the valve assembly of the present invention.

The valve assembly provided by the present invention can be more easily understood from a detailed description of the drawings. In FIG. 1 the valve assembly 1 is shown with housing 2 having low pressure inlet 3 above and on the opposite side of housing 2 from low pressure outlet 4. Also located on housing 2 is high pressure inlet 5 and high pressure outlet 6, which are similarly found on opposite sides of housing 2 and between low pressure inlet 3 and outlet 4. In FIG. 1 these inlet and outlet openings are shown as built up rectangular flanges 7 having numerous bolt holes 8 for attaching fluid and slurry conduits (not shown). The inlet and outlet openings are divided into two side-by-side compartments 9 and 10 with a central divider 11. Division of the inlets and outlets into compartments 9 and 10 central divider 11 provides for directing the low or high pressure slurry flow into or from the offset ports during the alternate filling and discharge and is present for strengthening housing 2. Further, instead of two compartments, three, four or more can be envisioned so long as the dividers do not unduly restrict fluid or slurry flow into and out of the valve assembly 1.

Housing 2 has liner 12 contacting it interiorly and has the same openings in registry with housing 2. Liner 12 is designed to accept wear and be replaced at much less cost than the replacement of housing 2. To maintain its lengthwise relation to housing 2, liner 12 has shoulder 13 fitting corresponding to shoulder 14 in housing 2. Housing 2 and liner 12 are maintained in relative rotational relationship, so that the inlet and outlet openings are in alignment, by seal welding liner 12 to housing 2 at and around all port openings.

Plug 18 is a tapered solid rotor adapted to rotate in housing 2 and is connected to drive shaft 17 having a plurality of offset ports 26 forming openings for a number of chambers 27 inside plug 18. Ports 26 are so arranged that as plug 18 rotates only one port 26 is exposed to any particular inlet or outlet of housing 2. Further, offset ports 26 are sized such that they are open to about one-half of the particular inlet or outlet. Moreover, each offset port 26 has a chamber 27 communicating with another offset port 26 opening on the opposite side of plug 18. Thus, upon rotation of plug 18, a first port 26 is exposed, for example, to one-half of the low pressure inlet 3 and communicates with a second port 26 on the opposite side of plug 18 communicating with low pressure outlet 4. Rotation of plug 18 and flow of slurry through chamber 27 causes the chamber 27 to fill. As plug 18 completes a ⅛th turn, both of the originally exposed ports are blinded and a second pair of ports 26 formed on the opposite half of the plug 18 is exposed and filled with low pressure slurry in the same manner as the first pair. As plug 18 passes through one-quarter turn, the originally exposed pair of ports 26 is opened to the high pressure inlet 5 and outlet 6 and the fluid at high pressure forces the slurry retained in the chamber 27 out and into the high pressure system with no communication to the low pressure side. As plug 18 continues through three-eights of a turn, the original pair of ports 26 are again blinded and the second pair of ports 26 on the opposite half of plug 18 are similarly exposed to the high pressure system and slurry is transferred to it. Continuing through one-half turn, plug 18 starts its cycle again but with opposite ports 26 exposed to the low pressure inlet 3 and outlet 4, i.e., the port 26 originally open to the inlet 3 is now open to the outlet 4. With plug 18 having a plurality of ports 26 and communicating chambers 27 and turning at some 4 to 7 rpms, large amounts of slurry can be delivered to the high pressure system without going through a booster pump which would soon fail because of solids wear on associated parts.

Because the ports 26 are open except when blinded, some slurry will be lost to the low pressure outlet 4. However, this does not present problems because it can be easily recycled to the low pressure inlet. Pressures on the low pressure side can range from 15 to 17 psig while pressures on the high pressure side can range from 200 to 300 psig. High pressure rotary plug valves in accord with the present invention may be designed for different pressures and for different pressure differentials.

The housing 2 is covered on each end by a drive end bell including a bell 15 located at the end of housing 2 near the motor drive (not shown) and adjustment end bell 16 located at the opposite end. Both end bells 15 and 16 contain bearings and seals of conventional type which are well known and need not be shown here. Passing through drive end bell 15 is a drive shaft 17 which is adapted to be connected to a drive means (not shown) at one end and is connected to rotary plug 18 at its other end. Drive shaft 17 is appropriately sealed and journaled by conventionally known methods. Adjustment end bell 16 has adjustment means 19 passing through it in axial alignment with drive shaft 17 and rotary plug 18. Adjustment means 19 is sealed, journaled, threadedly engaged in adjustment end bell 16 and connected to rotary plug 18, but handwheel 20 is attached without rotational connection to adjustment means 19 and is used to turn adjustment means 19 and axially displace rotary plug 18 relative to the housing 2.

Liner 12 has lubrication/flushing grooves 21 machined therein 360° completely around the liner 12 at both ends and the central portion. The grooves are located where the usual circular banding wear occurs in both plug and liner. The housing 2 and liner 12 are drilled and tapped forming holes 25 for pipe connections 22 to which are attached fluid lubrication and flushing lines 23 having control valves 24 located therein. The end of hole 25 can have shoulder 28 and o-ring 29 to seal the hole 25 and prevent leak back between the housing 2 and liner 12 or to the outside. The control valves 24 are located in each line so that as wear eventually does occur and axial adjustment is made, each lubrication/flushing line can be individually controlled.

The lubrication/flushing fluid can be any compatible fluid, such as liquid or gas, which is innocuous to the slurry liquid and contained solids. Preferably, the lubricating/flushing fluid is the same as the slurry liquid. The effect of pumping lubricating/flushing medium through housing 2 and liner 12 is to flush out fine solids trapped between the liner 12 and plug 18 thus decreasing wear. The fluid is forced by a circulating pump (not shown) through lines 23 into the drilled and tapped holes 25 and then between liner 12 and plug 18. The fluid acts as a lubricant also and thus decreases the load required to rotate plug 18. For example, modification in accord with this invention of a standard rotary plug valve in service as a high pressure chip feeder to a hydraulic digester in a pulp mill has decreased the current load about 40 percent in the electric motor drive. Concurrently, the resultant total energy load decrease for such an operation can be expected to amount to about a 40% decrease. Further, service life can be expected to be increased dramatically over the ordinary normal life expectancy before rebuilding is necessary.

Figure 2:
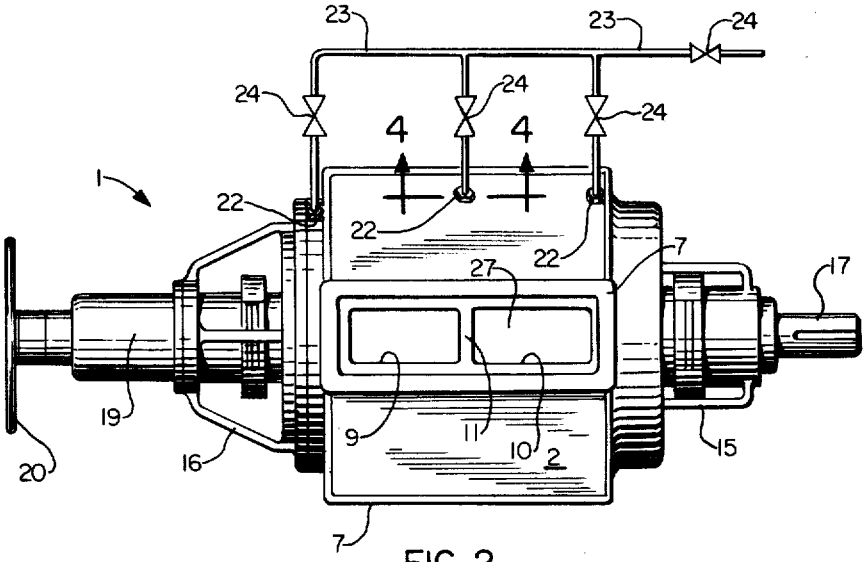
FIG. 2 is a top view of the valve assembly showing connection points of the fluid manifold and control valves therefor to the valve housing.

In FIG. 2 there is shown in more detail the placement of pipe connections 22 and the attachment of lines 23 and their associated control valves 24.

Figure 3:
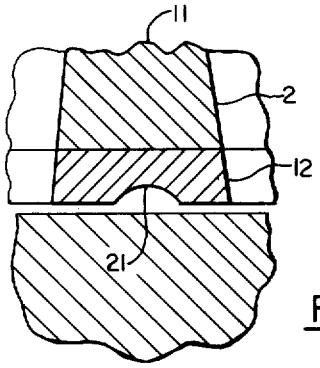
FIG. 3 is a partial sectional view taken along the lines 3—3 in FIG. 1 showing the groove in the central portion of the valve housing and plug.

FIG. 3 shows in detail the central portion of groove 21 in liner 12 on a central divider 11 of any inlet or outlet of housing 2.

Figure 4:
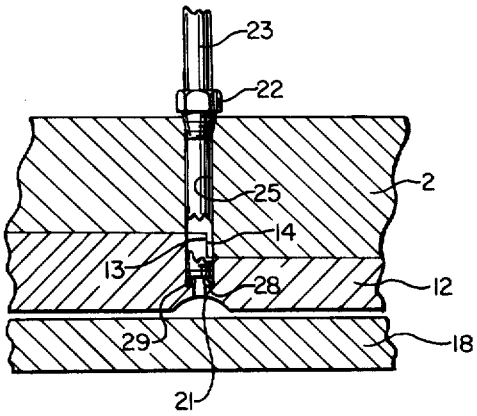
FIG. 4 is also a partial sectional view taken along sectional lines 4—4 in FIG. 2 and showing connection of the manifold pipes to the lubrication groove through the housing and liner.
Figure 5:
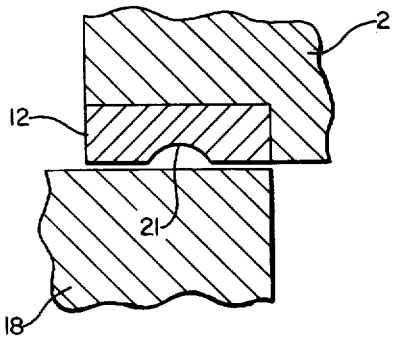
FIG. 5 is a partial sectional view of an end groove in said housing and liner, and adaptable to either end of said housing by reversing the drawing.

FIG. 4 shows in detail the connection of a lubrication/flushing line 23 in housing 2, passing through liner 12 and into central groove 21. Liner shoulder 13 and housing shoulder 14 are also shown in cross-section at the point of drilled and tapped flushing hole 25. In FIG. 5 there is shown in detail the end of liner 12 and housing 2 and plug 18 with a liner groove 21 therein.

As described herein, the valve assembly 1 provides an advantageous decrease in operating cost, increase in service life and decrease in downtime in highly critical high pressure operations. One skilled in this art will readily envision various changes and modifications which can be made in the present invention without departing from the scope and spirit thereof. Accordingly, it is desired that the invention be limited only by the lawful scope of the following claims.

What is claimed:

1. In a valve assembly adapted to receive a slurry at relatively low pressure and discharge the slurry to a system at relatively high pressure and comprising a housing having a low pressure slurry inlet and outlet means on opposite sides of said housing, a high pressure fluid inlet and slurry outlet means on opposite sides of said housing separated from said low pressure slurry inlet and outlet means, and a tapered valve plug having a plurality of offset ports therein defining the openings of a valve chamber between corresponding pairs of inlet and outlet offset ports, said valve plug being rotatably supported in said housing at one end by bearings and a drive shaft passing through a first end cover and at the other end of said housing by a laterally adjustable means passing through a second end cover, said valve plug ports being in registry with said housing inlets and outlets in a predetermined sequence during rotation of said valve plug, the improvement comprising means defining at least one annular groove contained in exposed communication between the radially separated relatively rotating surfaces of said valve plug and said housing at a selected longitudinal location corresponding to a location of potential banding wear therebetween, conduit means adapted continuously to supply fluid of the character of that being transferred from the low pressure side to the high pressure side from a source to said at least one groove and control means operative to control fluid flow in said conduit means so that upon rotation of said valve plug fluid in said conduit means is provided to said groove to establish a continuous lubricating/flushing flow between said housing and said valve plug surfaces thereat.

2. In a valve according to claim 1 in which said at least one annular groove comprises a plurality of separate longitudinally spaced apart annular grooves with each groove of said plurality being located at a said selected location and said conduit means is adapted to supply fluid to all of said grooves.

3. In a valve according to claims 1 or 2 including an annular liner secured to said housing intervening between the rotating periphery of said plug and the housing thereat and said at least one annular groove is contained in one of said plug or said liner.

4. In a valve according to claim 3 in which said at least one annular groove is contained in said liner.

* * * * *